United States Patent [19]

Larsen

[11] 4,006,511

[45] Feb. 8, 1977

[54] SWEEPER WITH RECIRCULATION HOOD AND INDEPENDENT FILTER SYSTEM

[75] Inventor: Gregory J. Larsen, Claremont, Calif.

[73] Assignee: FMC Corporation, San Jose, Calif.

[22] Filed: Feb. 9, 1976

[21] Appl. No.: 647,485

[52] U.S. Cl. ..... 15/300 A; 15/340; 15/346; 55/309; 55/385 B; 55/470

[51] Int. Cl.[2] ..... E01H 1/08

[58] Field of Search ..... 15/300 A, 340, 345, 15/346; 55/309, 385 B, 470

[56] References Cited

UNITED STATES PATENTS

| | | | |
|---|---|---|---|
| 1,560,612 | 11/1925 | Sims | 15/340 X |
| 3,186,021 | 6/1965 | Krier et al. | 15/340 |
| 3,505,703 | 4/1970 | Miller et al. | 15/340 |
| 3,540,073 | 11/1970 | Issenmann et al. | 15/340 |
| 3,824,771 | 7/1974 | Williams | 15/340 X |
| 3,872,540 | 3/1975 | Block | 15/340 X |
| 3,886,623 | 6/1975 | Landesman et al. | 15/340 X |

*Primary Examiner*—Christopher K. Moore
*Attorney, Agent, or Firm*—C. E. Tripp

[57] ABSTRACT

A mobile street sweeper employs a pickup hood through which air is circulated to entrain and pick up debris. The air circulation system includes a main blower and a smaller, auxiliary blower. The main blower inlet is connected to the debris hopper of the sweeper and air delivered by the main blower is directed to one end of the pickup hood. The other end of the pickup hood is connected by an air return line to the hopper. A filter for fine material is mounted on the hopper and has an air inlet that is in communication with the exterior surfaces of a plurality of tubular filter elements in the filter unit. The interiors of the filter elements are in communication with the inlet of the smaller auxiliary blower, which blower exhausts air to the atmosphere. The system is arranged so that about ¾ of the total system air flow is delivered to the hood by the main blower and about ¼ of the total system air flow is exhausted to the atmosphere by the auxiliary blower, via the hopper and the filters. The difference between these flow rates is made up by air leaking in and under the flaps of the hood, and into the shroud of a curb broom, the shroud being connected to the full flow air return line leading from one end of the hood to the hopper.

16 Claims, 9 Drawing Figures

FIG_7
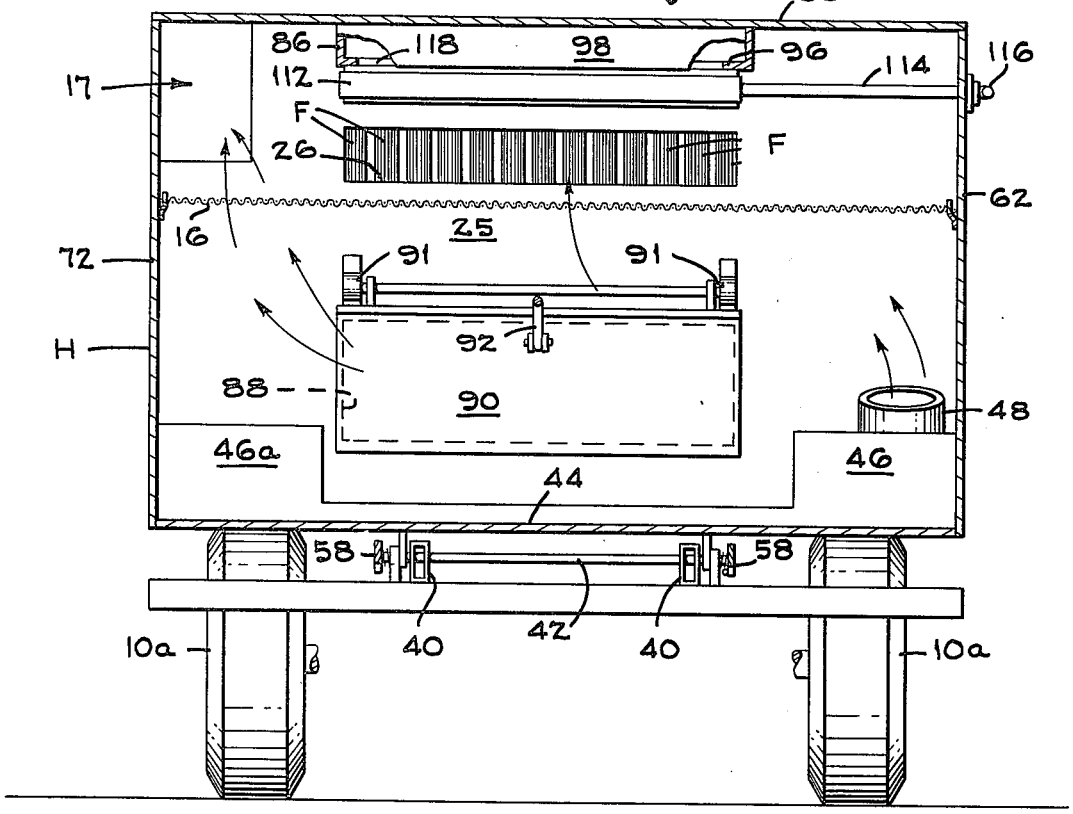
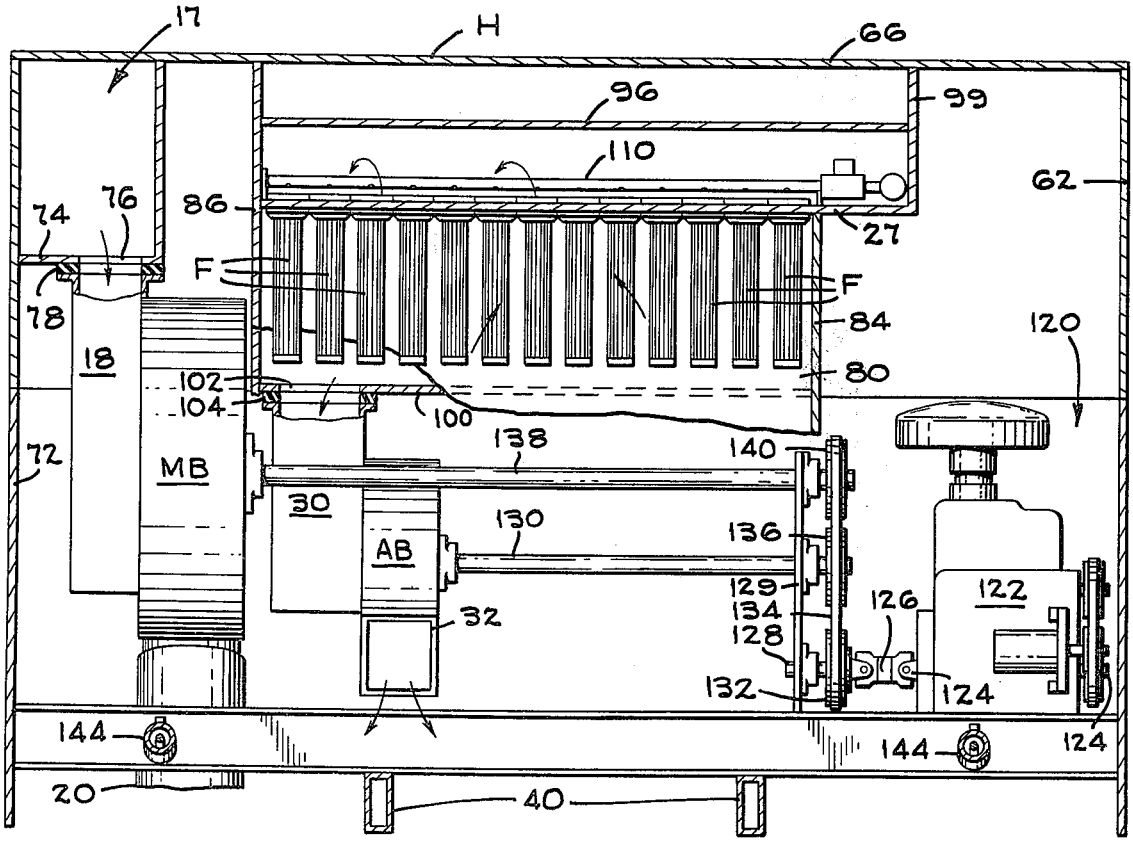
FIG_8

SWEEPER WITH RECIRCULATION HOOD AND INDEPENDENT FILTER SYSTEM

FIELD OF THE INVENTION

This invention relates to street sweepers or the like and more specifically to such sweepers wherein the debris is swept by entraining it in a blower-induced stream of air that flows through a sweeping or pickup hood and on to a hopper.

DESCRIPTION OF PRIOR ART

The United States patent to Rydberg U.S. Pat. No. 2,932,845, Apr. 19, 1960, discloses a mobile pneumatic cleaning device which includes a hopper, a single main blower having its inlet connected to the hopper, and a pickup hood that receives air from the blower. Air and debris are exhausted from the hood by a return air line connecting the hood to the hopper. This is one of several prior proposals wherein the overall efficiency of a sweeper is augmented by creating a circulation of air through the hood. The device of Rydberg has another feature in that the single blower has a second outlet, which outlet is considerably smaller than the main blower outlet that directs air to the pickup hood. The second outlet of the blower forces air from the hopper through fine debris filters, for discharging filtered air to the atmosphere. The amount of air delivered to filters by the auxiliary main blower outlet of Rydberg is considerably less than the amount of air delivered by the main blower to the pickup hood.

The Bailly U.S Pat. No. 1,459,968, issued June 26, 1923, discloses a vacuum cleaner that operates on the principle of the Rydberg patent except that the hood surrounds a broom. A single main blower draws air from the hopper. The blower outlet has three branches that deliver air to the hood and a fourth branch that forces air through a filter. A three branch air return line connects the hood to the hopper.

A system embodying the principles of the Rydberg patent was studied by applicant's assignee, the FMC Corporation, and rejected as unsatisfactory for normal street sweeping use. In the system tested, it was intended that three fourths of the total air delivered by the main blower would be directed to the hood and that a second main blower outlet would direct one quarter of the total air flow leaving the blower through fine filters. All of the air entering the blower was exhausted from the hopper and a return air line was provided from the hood to the hopper for delivering air and entrained debris to the hopper. It was intended that all of the air delivered by the main blower to the hood (about ¾ of the main blower total outlet) be recirculated through the hood and returned to the hopper. This would cause about ¼ of the total flow in the return air line to the hopper to enter the system as makeup air by the flow of atmospheric air from under the flaps of the hood and from under a curb broom shroud, if present. This makeup air would join the air stream flowing in the hood, would enter the hopper via the air return line, and would minimize the puffing of dust from under the flaps of the hood to the atmosphere. However, it was found that use of the small second blower outlet from a single main blower for delivery of one quarter of the total air flow from the blower through a filter system was difficult to keep in balance, due to variations in pressure drops that occurred at both the hood and at the filter. Variations in pressure drops at the hood occur when the hood flaps pass over depressions or obstructions on the swept surface, that lift the flaps from the surface. Variations in the pressure drop across the filter will occur due to changes in the effective porosity of the filter elements caused by build up of dust on the filter elements during operation. Also, since the pressure drop across the filter is higher than the pressure drop across a raised hood flap, when a road obstruction lifts a hood flap, air from the auxiliary outlet of the single main blower that was intended to be forced through the filter took the path of least resistance and puffed out from under the hood flaps.

The U.S. Pat. No. 3,662,427 to Hanna, issued May 16, 1972, discloses a system wherein a single main blower has an inlet that draws air through a screen in the hopper and the main outlet delivers air to the pickup hood. A water spray is introduced into the air stream leaving the hood. There is no filter for fine dust particles.

Applicant's assignee has experimented in Europe with a sweeper system which employs a single main blower that does not recirculate air through the hood. In this system, air is drawn from the hood into the hopper by the blower and the blower exhausts air from the hopper directly to the atmosphere. This required the introduction of a water spray into the air stream from the hood in order to prevent the blower from discharging dusty air to the atmosphere. As a result, the hopper would accumulate a large quantity of water, which increased the loads and required more frequent dumping.

Another air flow system in a sweeper is shown in the Davis U.S. Pat. No. 3,651,621, issued June 26, 1923. In this patent there is no recirculation of air back to a pickup hood. All the air drawn from the hood passes through the hopper and then passes through dust filters into the entrance of a single main blower. Thus the pickup hood, the hopper, the filters and the blower are connected in series, and filtered air from the single main blower is discharged to the atmosphere. This series system requires that all of the air drawn from the hood must pass through the fine dust filters. Thus, in order for the system to provide a large volume flow of air, a large volume filter system and a high capacity blower are required to accommodate the pressure drop of the large air flow across the filters.

In the Young U.S. Pat. No. 3,512,200, issued May 19, 1970, a single main blower directs air to the hood and exhausts air from the hopper through vibrating reed separators and fine particles are separated out by a cyclone separator. An air return line returns air from the hood to the hopper. There is no discharge of air from the blower to the atmosphere. This full recirculation system to and from the hood puffs dust out from under the hood flaps on irregular swept surfaces and under dusty conditions water is sprayed into the air inlet line to the hood. The filter-separator assembly must be large to accommodate a large recirculation air flow and the resultant head losses require a large blower.

The United States patent to Miller et al. U.S. Pat No. 3,505,703 issued Apr. 14, 1970, discloses a street cleaner having a square suction hood with single suction line connected to a lower, debris chamber of the hopper. The hopper is partitioned off to form an upper, low pressure chamber that contains a plurality of inertial dust separators. The air inlet of a vacuum fan is connected to the upper chamber and the fan exhausts to the atmosphere. All of the air entering the vacuum fan from the low pressure chamber must pass through the inertial separators. The separators are cleaned by two smaller fans which withdraw dust collected within the separators and deliver it to the debris chamber of the hopper. As in the Young U.S. Pat. No. 3,512,200, since all of the air flow passes through dust separators the latter occupy a large volume and require the use of a large blower.

The Young U.S. Pat. No. 3,242,521, issued Mar. 29, 1966, discloses a sweeper having a single main blower with its inlet connected to a vacuum assembly at a curb brush and with its outlet connected to a bin or hopper. The hopper is pivotally mounted at the rear and the air inlet to the hopper makes a separable sealed connection with the blower outlet.

SUMMARY OF THE INVENTION

In the sweeping system of the present invention, air is circulated through a pickup hood in order to utilize the energy of a stream of air flowing from the main blower for scrubbing the surface, entraining debris in the air stream and delivering the air-entrained debris to the hopper. The system employs the principle of withdrawing more air from the pickup hood than is introduced thereto by the main blower. This would induce a negative pressure in the hood, but air from outside of the hood flows in under the flaps as makeup air. The amount of makeup air represents the difference between the amount of air introduced into the hood by the main blower and the amount of air withdrawn from the hood via the hopper. The flow of makeup air under the hood flaps minimizes the puffing of dust from within the hood, in case the flaps are temporarily lifted by a surface irregularity or a large article of debris.

As mentioned, in the system of the present invention, the main blower delivers less air to the hood than is withdrawn from the hood via the hopper. The difference between the amount of air flow flowing from the hood to the hopper and the amount of air flowing into the hood from the main blower is supplied by a separate and independent auxiliary blower. In the present invention, the auxiliary blower withdraws air (the equivalent of the aforesaid makeup air) from the hopper through a filter that removes fine dust particles from the air stream and the auxiliary blower exhausts filtered air to the atmosphere.

To give a typical example, it wil be assumed that the main blower withdraws ¾ of the total system air flow from the hopper and introduces it into the pickup hood. In the present example, this flow may represent 3,000 cubic feet per minute (c.f.m.). The auxiliary blower is considerably smaller and in this example, will draw 1,000 c.f.m. from the hopper through the filters and exhaust the filtered air to the atmosphere. Thus, 3,000 c.f.m. are entering the hood, 4,000 c.f.m. are withdrawn from the hood into the hopper, and 1,000 c.f.m. will leak in from under the hood flaps as makeup air to make up the flow difference. This system, including the use of separate blowers, a main blower for hood recirculation and a separate and independent auxiliary blower for drawing an additional amount of air from the hood equivalent to that which leaks into the hood (and into the curb brush shroud if a curb brush is employed), with the auxiliary blower drawing air through a separate filter and exhausting filtered air to atmosphere, has several advantages. Air is not puffed out from around the hood flaps and approximately balanced flow conditions can be maintained even though the contact or sealing conditions of the hood flaps with the swept surface may vary and even though variations in pressure drop across the filter may take place.

The filters, through which the auxiliary blower draws ¼ of the flow from the hopper in the example, are automatically cleaned at frequent intervals during operation so that prolonged increases in the pressure drop across the filters due to dust build up cannot occur. Furthermore, as dust accumulates on the filters between the automatic cleaning cycles, the auxiliary blower will always force a substantial flow of air through the filters, and this air flow added to that from the main blower, will continue to induce makeup air into the sweeping units.

To summarize, the system of the present invention has the following features:

1. Air recirculation can be employed in the pickup hood. Thus, kinetic energy imparted to a stream of flowing air can be utilized to assist the sweeping action.
2. Dust is not puffed out from under the hood if the flaps are lifted, because makeup air always flows into the hood from under the flaps.
3. Only a filtered air flow (equivalent to the make up air flowing into the hood) is exhausted to the atmosphere.
4. The selected basic flow rates can be maintained, within practical limits, during prolonged and varied operations of the sweeper embodying the system. As the pressure drop across the filters increases between filter cleaning cycles, the auxiliary blower will continue to draw air through the filters, and this volume of air represents the volume of air that is drawn into the hood and sweeping units from the atmosphere.

The manner in which these advantages can be attained will be apparent from the detailed description of a preferred embodiment.

BRIEF DESCRIPTION OF THE DRAWINGS

FIG. 7 is a rear vertical section taken on line 7—7 of FIG. 6.

FIG. 8 is a vertical section taken on line 8—8 of FIG. 6, showing a blower drive mechanism, with parts broken away.

FIG. 9 is a view like FIG. 3 showing the hopper in its elevated or dumping position.

DESCRIPTION OF PREFERRED EMBODIMENT

General Description

Figure 1:
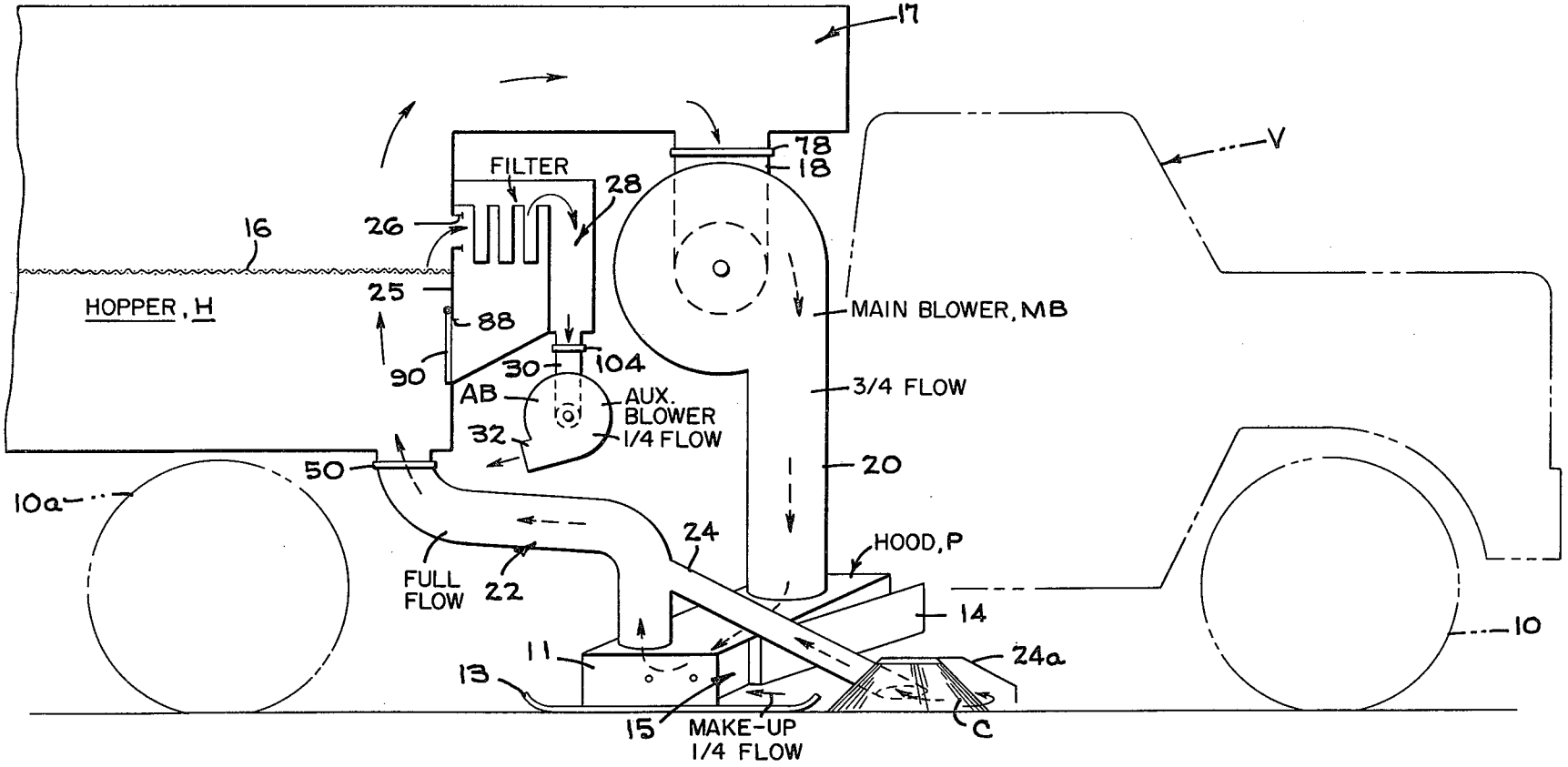
FIG. 1 is a schematic diagram of a two blower recirculation system embodying the present invention.
Figure 2:
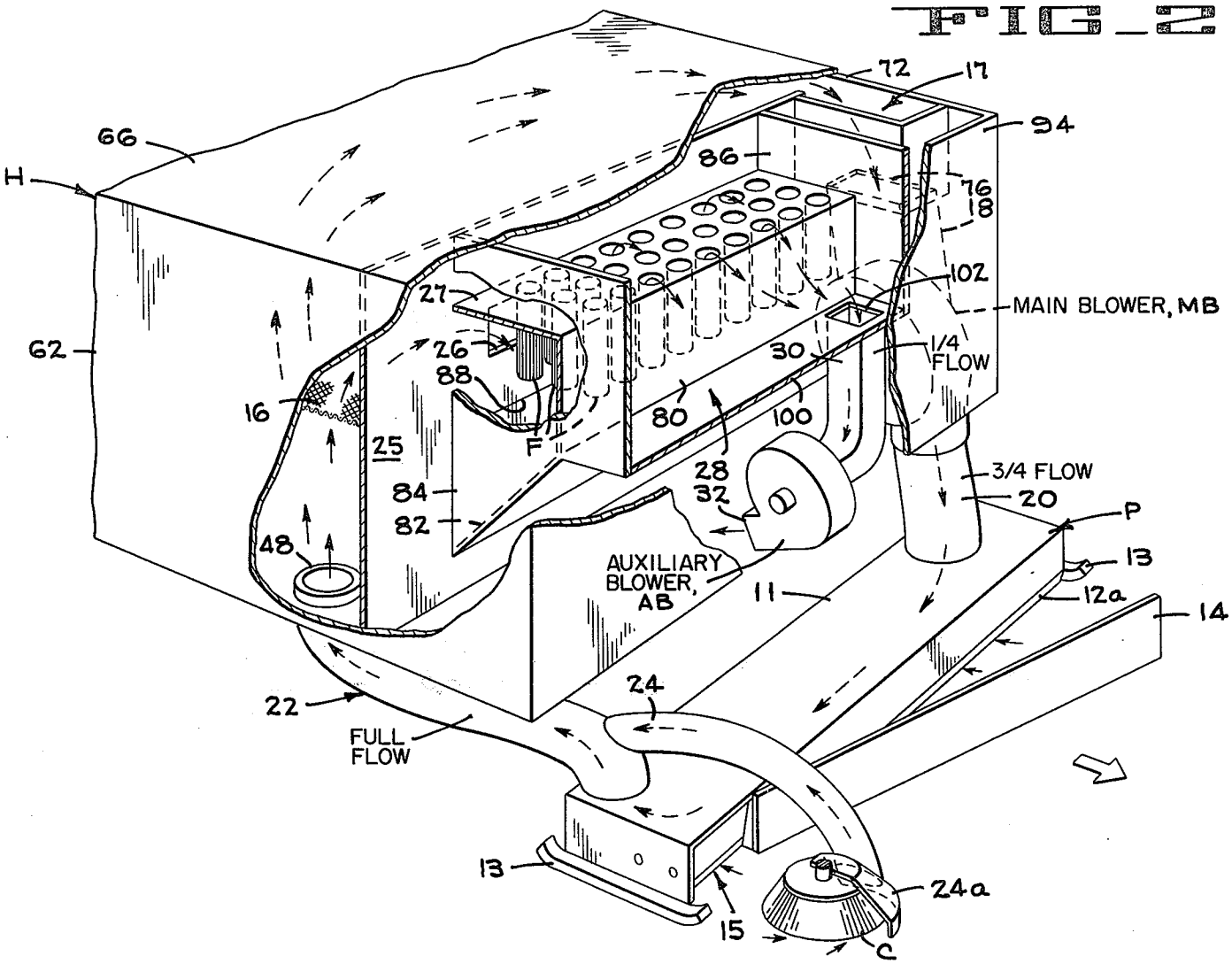
FIG. 2 is a fragmentary schematic perspective view of the system indicating the general arrangement of the basic units in the preferred embodiment.

Before describing a complete sweeper embodying the present invention, the principles of the mode of operation of a sweeper system embodying the invention will be summarized in connection with the diagram of FIGS. 1 and 2.

FIG. 1 is a highly schematic diagram indicating the flow pattern in the air system and FIG. 2 is a schematic perspective which so indicates the flow pattern but the filter system is shown in a manner which more closely approximates details of the preferred construction.

Referring principally to FIGS. 1 and 2, the sweeping system is mounted on a mobile vehicle V, which may be a converted truck chassis, the chassis being signified by the front and rear wheels 10,10*a*. The sweeping system includes a main debris pickup unit in the form of a pickup hood P, which is mounted on the chassis and provides a transversely mounted duct-like housing. The hood has surface engaging skids at each end and has surface engaging flaps, which will be described presently. The internal construction and principle of operation of accelerated air circulation through the hood P forms the subject matter of the copending application of Larsen and Hiszpanski, Ser. No. 647,305, filed Feb. 5, 1976, assigned to the FMC Corporation.

Figure 5:
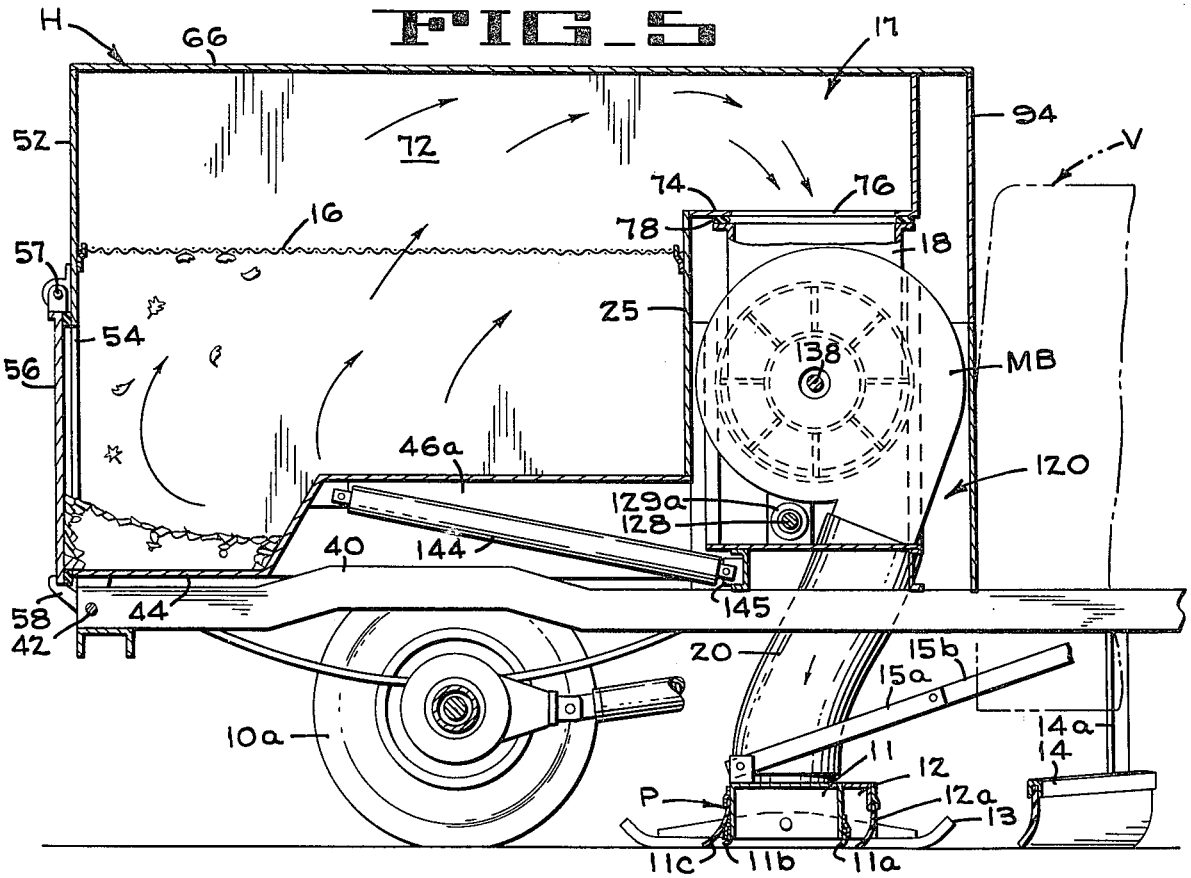
FIG. 5 is a section through the sweeping system taken on line 5—5 of FIG. 4.

The sweeping hood P is mounted on the vehicle chassis by a floating suspension. The hood has a recirculating air channel or duct 11 with surface engaging front flaps 11*a* and rear flaps 11*b*, 11*c*, (Fig. 5). A front, dead air chamber 12 has a flap 12*a*. The ends of the hood are supported on skids 13. As seen in FIG. 2, associated with the hood P is a deflector 14 which windrows large articles, such as cans or the like, laterally to an airlock system indicated generally at 15 wherein the articles are admitted to the duct 11 of the hood P without opening the hood to the atmosphere. Incorporation of the deflector 14 and the airlock system 15 is not essential to the basic air flow system of the present invention.

Figure 6:
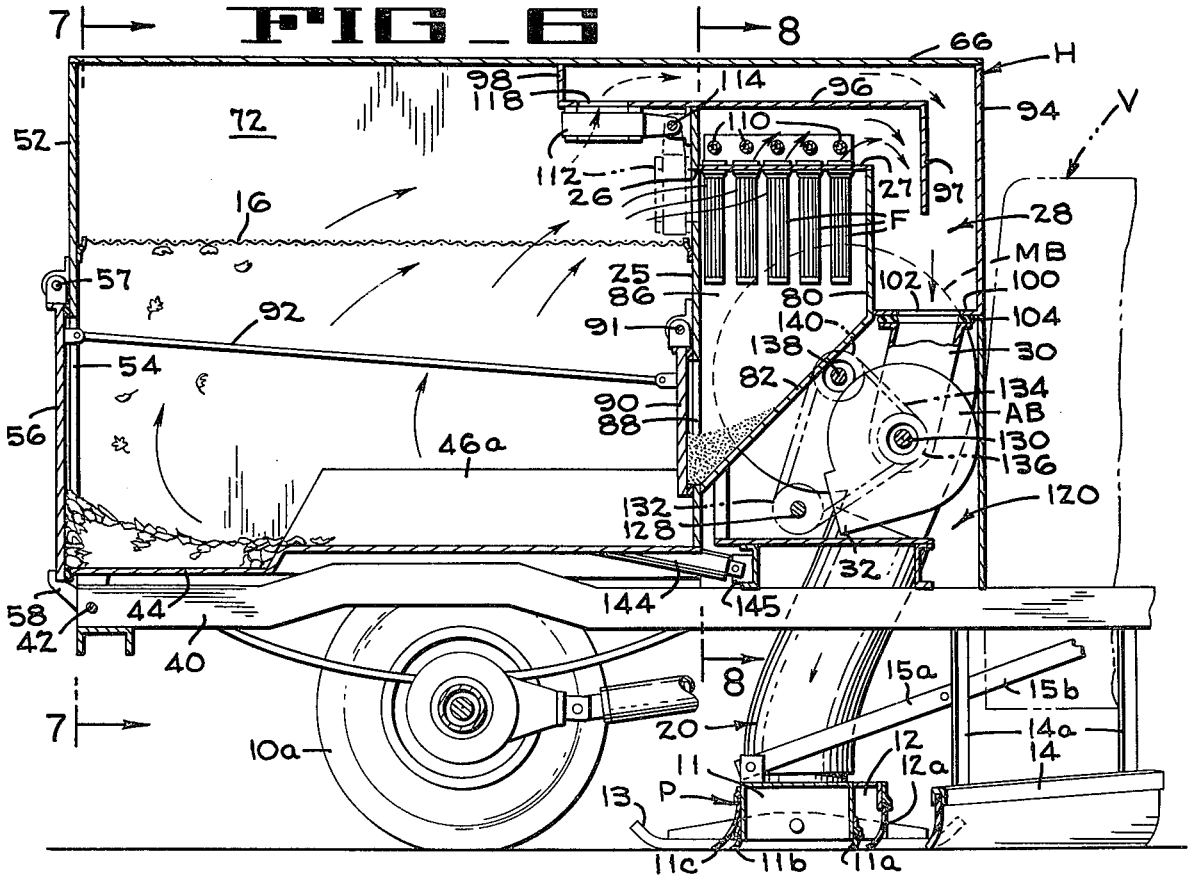
FIG. 6 is a section like that of FIG. 5 taken on line 6—6 of FIG. 4.
Figure 5:
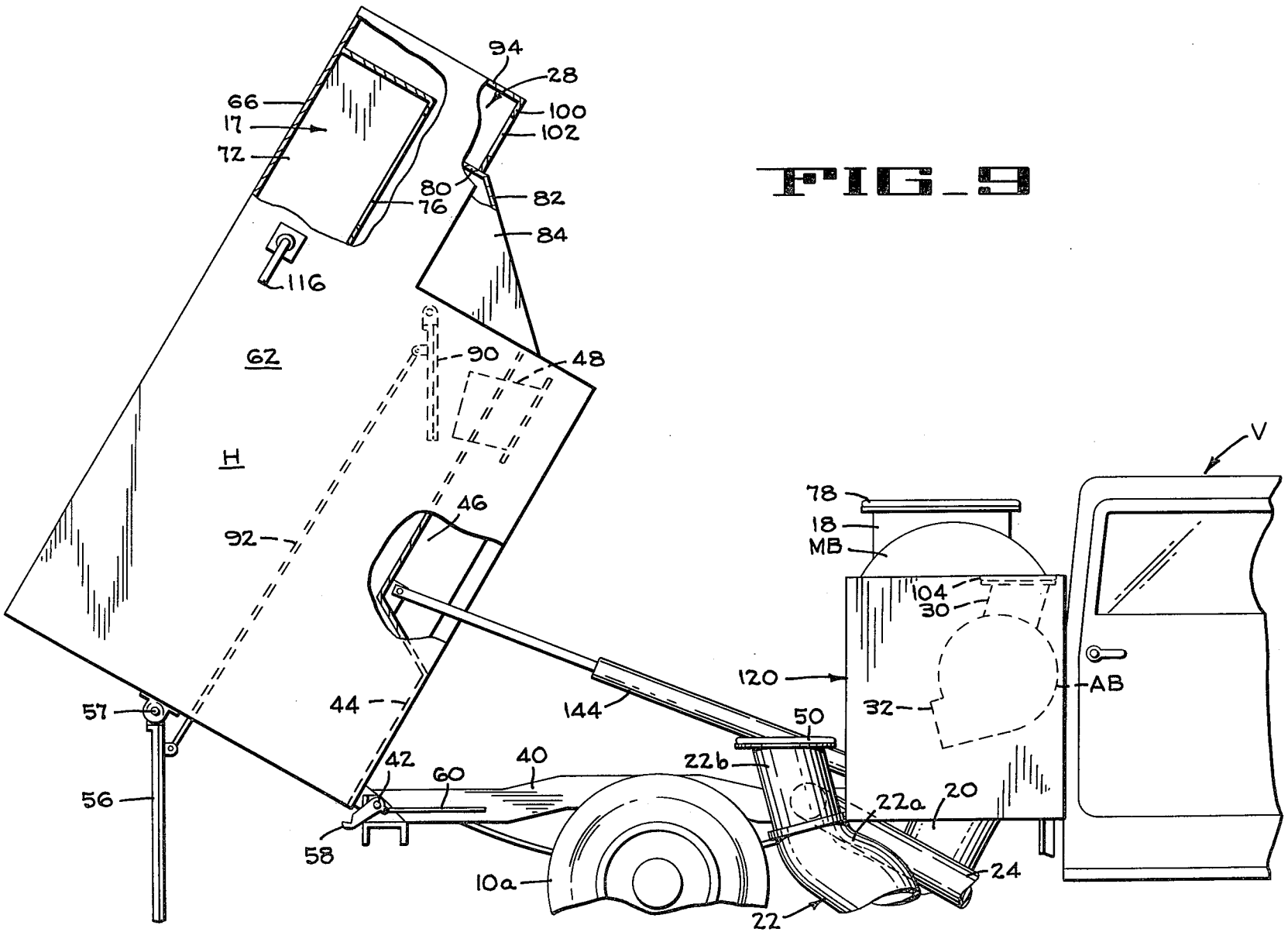

As seen in FIGS. 5 and 6, the hood P is dragged along the surface by links 15*a* that are pivotally connected to trailing arms 15*b* that project rearwardly from the chassis. The deflector 14 can be either supported on the hood or suspended from the vehicle chassis by straps 14*a*. The details of the hood and deflector mountings are not critical to the present invention.

The airlock system 15 forms the subject matter of my copending application, Ser. No. 647,521 filed Jan. 8, 1976 entitled Pickup Hood With Air Lock, also assigned to the FMC Corporation.

Returning to FIGS. 1 and 2, pivotally mounted at the rear of the vehicle chassis is a debris hopper H. This hopper is a box-like structure that can be elevated about a pivot (FIG. 9) to discharge accumulated debris through a rear door, as will be described presently.

The hopper H is fitted with a screen 16 to filter out coarse debris and one side of the hopper is formed with a forwardly projecting air exhaust chamber 17 which, during the sweeping operation, connects with the inlet 18 of a main blower MB. The main blower withdraws air from the hopper and delivers it to one end of the duct 11 of the pickup hood P by an air delivery or hood inlet line 20. An air return line 22 is connected between the other end of the hood duct and the bottom of the hopper H, and the return line draws a debris laden air stream into the hopper. In the embodiment shown, a suction line 24 is connected to the air return line 22, and the line 24 exhausts air and dust from within a shroud 24*a* that partially surrounds a curb brush C.

A front wall or partition 25 of the hopper H is formed with an opening 26 which communicates with a compartment containing a filter assembly for filtering out fine particles. The filter system comprises a series of tubular, porous filter elements F depending from a partition 27 into a dust collecting chamber of the filter. Preferably, the filter elements are pleated paper elements constructed in accordance with the principles of the copending application of Groh Ser. No. 604,275, filed Aug. 13, 1975 and assigned to the FMC Corporation. Air is drawn through the porous walls of the filter elements, depositing dust on their exterior surfaces. Filtered air is drawn out through the open upper ends of the tubular filter elements into a filtered air chamber 28, which is connected to the inlet 30 of an auxiliary blower AB. The exhaust 32 of the auxiliary blower delivers filtered air to the atmosphere.

As previously described, the present invention makes it possible to utilize the principle of air circulation through the pickup hood without puffing dust out from under the hood.

In the preferred embodiment of the present invention, the main blower MB is sized and rotated at such a speed as to deliver about ¾ of the total system air flow (3,000 c.f.m., for example) to the hood P via the line 20. This means, of course, that ¾ of the total system air flow enters the main blower through the line 18 from the hopper exhaust chamber 17.

The auxiliary blower AB exhausts abut ¼ of the total system air flow from its inlet line 30. The inlet line 30 draws air from the filtered air chamber 28, through the filter assembly F and from the hopper H through the elongate opening 26 in the front wall 25 of the hopper. With the main blower drawing ¾ of a total air flow from the hopper and the auxiliary blower drawing ¼ of that flow from the hopper, the result is that the full air flow of the system is drawn through the air return line 22 leading from the pickup hood P to the hopper. The difference between the full system air flow in the return line 22 and the ¾ system air flow in the line 20 entering the hood is supplied by makeup air which flows in from the atmosphere under the flaps of the hood. If a curb brush C is fitted, part of the makeup air flows in along the scrubbed surface under the shroud 24*a* of the curb brush and hence via the line 24 to the full flow air return line 22. Since air always flows from the outside to the inside to the sweeping assemblies, puffing of dust from under the hood flaps, a common problem in recirculation systems, is substantially eliminated. The use of independant blowers, blower AB for the fine filter units, and blower MB for circulating air through the hood, renders the system substantially self-balancing when operating under substantially the designed flow rate conditions over a wide range of actual sweeping conditions, particularly when the filters are periodically cleaned. The main blower is connected directly between the hopper chamber 17 and the pickup hood P by the line 20 and hence the main blower need not be of excessive size because there are no fine filter elements in series with that blower.

The effectiveness of the system is enhanced by the use of a hood formed with the large article deflector 12 and the air lock 14, forming the subject matter of the aforesaid copending Larsen application, Ser. No. 647,521, filed Jan. 8, 1976 because the hood flaps are not lifted by the entrance of large articles of debris and the flaps can be constructed so as to provide a controlled flow of makeup air into the hood.

DETAILED DESCRIPTION

Referring to FIGS. 3–9 the hopper H is supported on frame elements 40 (FIGS. 3 and 7) by a pivot rod 42 so that the hopper can be elevated to its dumping position shown in FIG. 9. The hopper has a bottom wall 44 formed with wheel wells 46 (FIG. 3) and 46*a* (FIG. 7). The right hand wheel well 46 has bolted thereto pipe 48 (FIG. 3) which makes sealing connection by means of a gasket 50 (FIGS. 3 and 9) with a pipe 22*b*. The pipe 22*b* is clamped to a large flexible hose 22*a*, the parts 22*a*, 22*b* and 48 forming the air return line 22 from the pickup hood P to the hopper.

The hopper has a rear wall 52 with a dump opening 54 closed by a door 46 pivotally mounted on the hopper wall at 57. The door is maintained in its closed position by manually operated latches 58 on the pivot rod 42 (FIG. 7). The latches can be controlled by means, not shown, from the driver's compartment through an operating cable 60 (FIG. 3) and they are spring urged into their latched position. Referring to FIG. 7, the right side wall 62 of the hopper is adjacent to the air return line inlet 48. The forward portion of the hopper is provided with the vertical partition 25, which is formed with an elongated opening 26, previously described, to admit air from the hopper to the filter units F. As seen in FIG. 6, the screen 16 extends from the partition 25 to the rear wall 52 of the hopper and as seen in FIG. 7 the screen 16 extends laterally between the right side wall 62 and the left side wall 72 of the hopper.

As mentioned, the chamber 17 is in communication with and forms a forward extension of the hopper. Air from the hopper flows through chamber 17 as it enters the inlet 18 to the main blower MB. The main blower is at the left of the filter units F, as seen in FIGS. 7 and 8 and is in front of the partition 25, as seen in FIG. 5. As seen in FIGS. 5 and 8 the lower wall 74 of the chamber 17 is apertured at 76, which aperture also appears in FIG. 4. This rectangular aperture 76 makes a sealing connection by means of a gasket 78 (FIGS. 5, 8 and 9) with the inlet duct 18 of the main blower previously described.

As to the filter portion of the sweeper, the partition 27, from which the filters F are suspended, has been previously mentioned. Partition 27 projects forwardly from the front partition 25 of the hopper. The filters depend into a fine dust collecting chamber which is formed by a front vertical wall 80 (FIGS. 2 and 6) that joins a rearwardly inclined bottom wall 82 that cooperates with the hopper partition 25 to form a dust collection chamber. The partition dust chamber is closed by side walls 84, 86, best seen in FIG. 4. The partition 25, which forms one wall of the fine dust collecting chamber, is apertured at 88 (FIG. 6) for discharging fine dust when the hopper is elevated. The discharge aperture 88 is closed by a door 90 (FIG. 6), pivotally mounted at 91 on the hopper partition 25. The door 90 is linked to the main hopper rear door 56 by a link 92. With this construction, both doors 56 and 90 can be opened for dumping debris when the hopper is elevated, as shown in FIG. 9.

Figure 4:
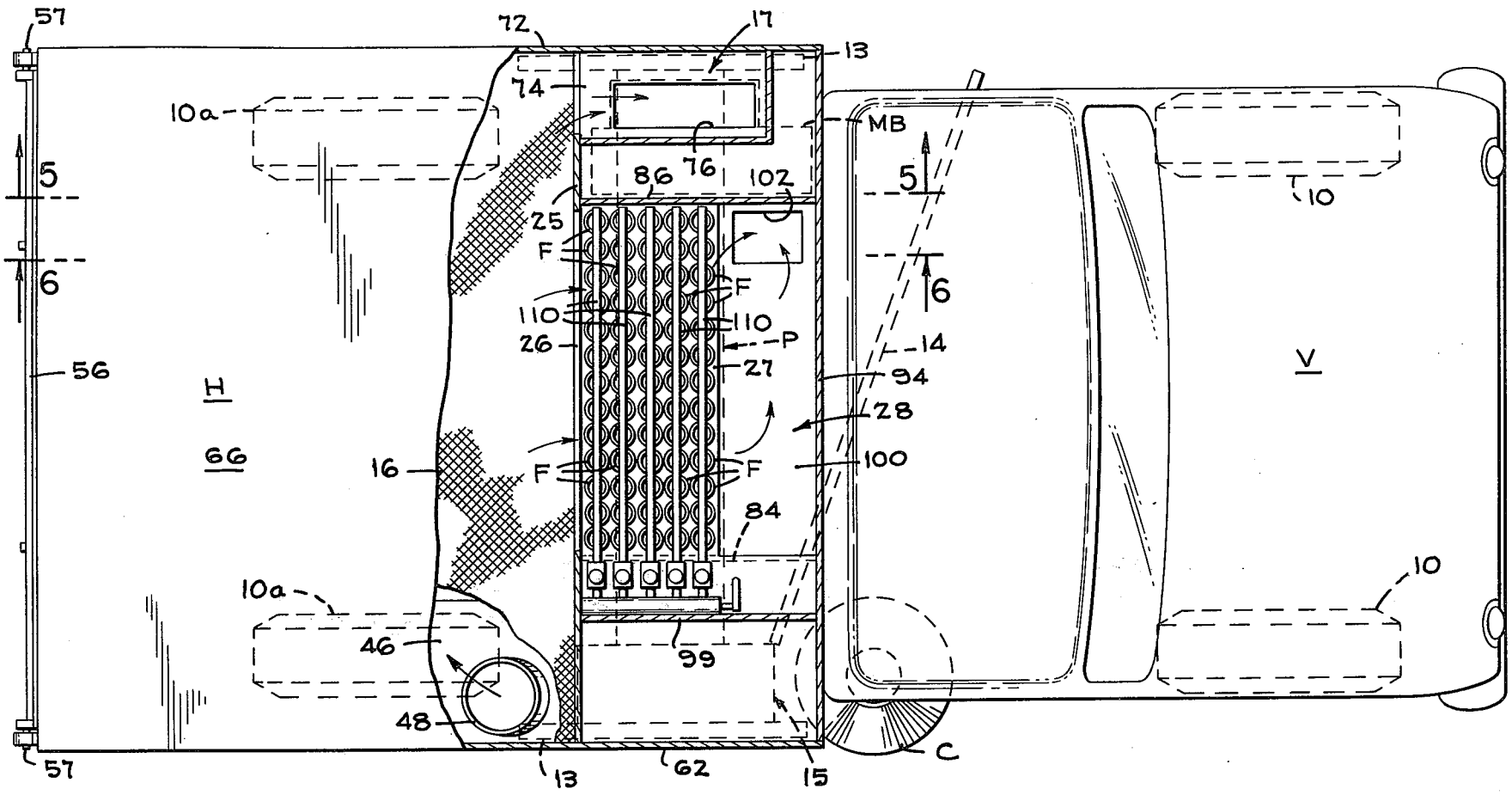
FIG. 4 is a plan of the system of the present invention with parts broken away.

Continuing with the description of the filter system, the chamber 28 receives filtered air drawn through the walls of the filter elements F, which air leaves through the open upper end of each filter element as has previously been described. As best seen in FIGS. 6 and 8, the filtered air chamber 28 is defined by the vertical wall 80, the previously mentioned partition 27 that supports the filter elements, and the upper wall or roof 66 of the hopper. Also closing off the filtered air chamber 28 is a front vertical wall 94 (FIG. 6) which is also a front wall of the hopper. A horizontal baffle 96 (FIG. 6) extends across the upper end of the hopper partition 25. The front edge of the baffle 96 has a downwardly extending flange 97 and the rear edge of the baffle 96 joins a vertical closure flange 98 (FIGS. 6 and 7) extending between the baffle 96 and the roof 66 of the hopper. The chamber 28 is also defined by a side flange 99 extending between the roof of the hopper 66, the partition 27, (FIG. 7) and the upper portion of the side wall 86. The lower portion of the filtered air chamber 28 is closed by a flange 100 (FIGS. 2, 4 and 6). The flange 100 is formed with an opening 102 (FIGS. 4 and 6) to be brought into sealing engagement with a gasket 104 (FIG. 6) mounted on the inlet 30 to the auxiliary blower AB.

In order to minimize variations of pressure drop that occur across the tubular porous filter elements F, these elements are periodically and automatically cleaned by pulses of high pressure air directed to jet tubes 110 which have openings centered above the normal outlet of each filter element. The details and nature of the manner in which the filter elements are periodically cleaned are not critical to the present invention. The system illustrated in this application is like that disclosed in the aforesaid copending application of Groh, Ser. No. 604,275, filed Aug. 13, 1975. Other suitable filter cleaning systems, such as that shown in the U.S. Pat. No. 3,395,519 to Kleissler, issued Aug. 6, 1968, may be employed.

Means are provided to bypass the filter elements F under wet conditions wherein rapid caking on the elements might occur. Accordingly, and as seen in FIGS. 6 and 7, a bypass door 112 is pivotally mounted on a shaft 114 (FIG. 7) and can be manually operated by handle 116. Bypass opening 118 (FIGS. 6 and 7) is formed in the horizontal baffle 96 previously described. In normal operation, the door 112 is raised to the position shown in solid lines in FIG. 6, closing off the bypass aperture 118 and directing air through the aperture 26 against the outer surfaces of the filter elements F. Under wet conditions, the bypass door 112 is moved to its lower position shown in broken lines in FIG. 6. This closes off the entrance 26 to the filter elements and causes air drawn into the compartment 28 by the auxiliary blower AB to enter through the elongated aperture 118 in the wall 96, which air therefore enters the blower without having been drawn through the filter elements. The baffle 96 prevents wet debris from dropping into the filter elements. Of course, under these conditions, the discharge of air directly to the atmosphere by the auxiliary blower AB is not objectionable because the moist dust drops out in the hopper and a minimal amount of the dust is entrained in the air.

DRIVES

Figure 3:
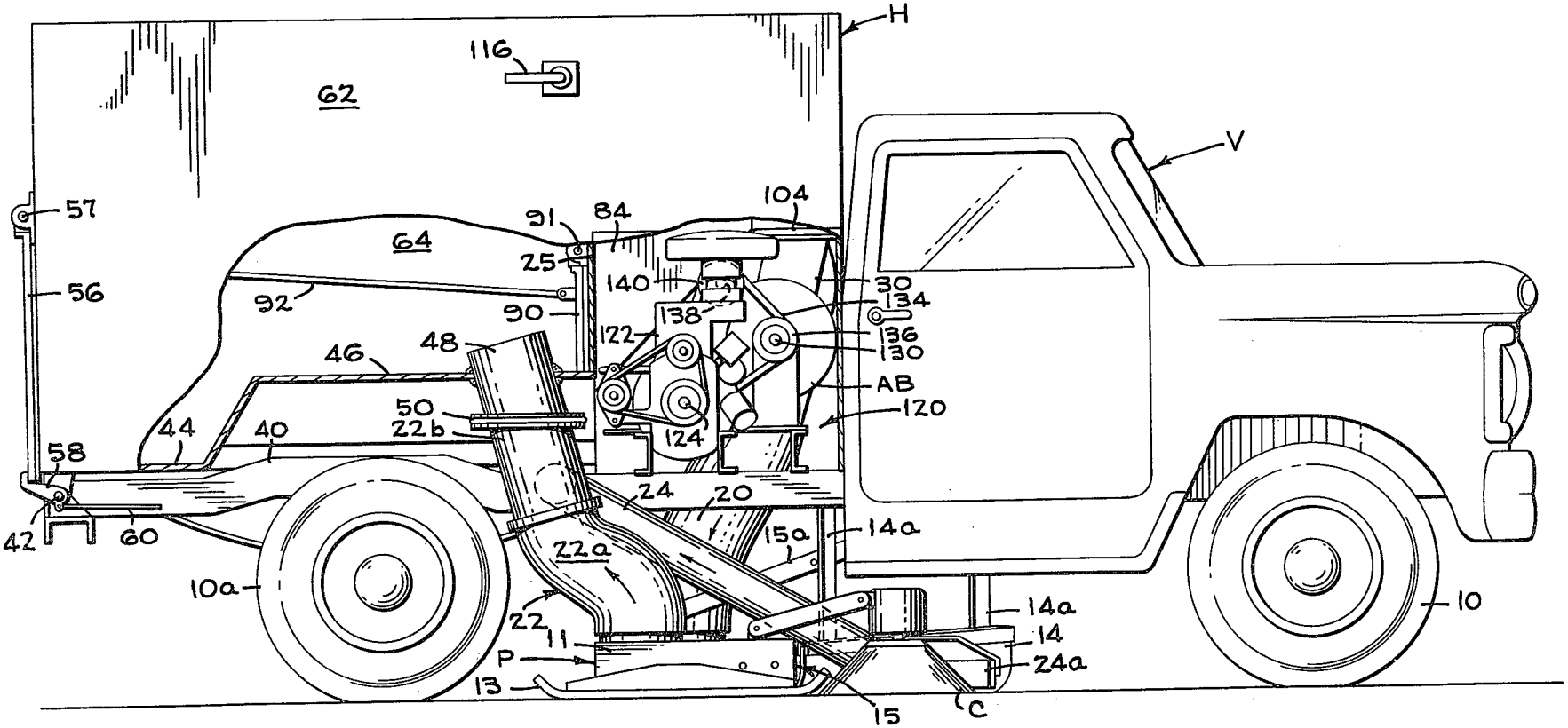
FIG. 3 is a side elevation of the sweeping apparatus of the present invention mounted on a truck chassis, with parts broken away.

The blowers, the driving mechanism for the blowers and an engine that drives them all are mounted in a compartment 120 (FIGS. 3, 5, 6 and 8 and 9) that remains fixed on the chassis frame when the hopper is tilted, as shown in FIG. 9. Within the compartment is a source of power such as an internal combustion engine 122 (FIGS. 3 and 8). The rear end of the crankshaft 124 of the engine is connected to a universal joint 126 (FIG. 8) which drives a pulley shaft 128 supported in a bearing plate 129 on the truck platform. The shaft 130 of the auxiliary blower AB is supported in the bearing plate 129 and is driven from a pulley 132 on the shaft 128 (FIGS. 3 and 8), a V-belt 134 and a pulley 136 on the blower shaft 130. The shaft 138 for the main blower MB is also supported in the bearing plate 129 and is driven by the same V-belt 134 and a pulley 140 on the end of the blower shaft. In the illustrated embodiment of the invention, the blowers are so sized and are driven at such speeds that the main blower MB circulates about 3,000 c.f.m. of air and the auxiliary AB blower circulates about 1,000 c.f.m. of air.

DUMPING

In order to pivot the hopper H about its pivot rod 42 as previously described, two fluid piston and cylinder assemblies 144 (shown in section in FIG. 8) are pivotally connected between the hopper H and ears 145 (FIG. 5) on the frame 40 of the truck chassis. When the assemblies 144 are extended, the hopper is tilted and when the latches 58 are operated to release the main hopper door 56, the hopper door is opened by the force of gravity and the filter dust door 90 is opened by the link 92. Thus, fine particles of dust that have dropped down into the filter chamber and dirt and debris that have accumulated in the hopper H both flow out of the hopper for dumping at a desired location.

OPERATION

The basic principles of operation of a street sweeper embodying the present invention have been described in the opening remarks so they will only be summarized. The hopper H is lowered into position to seal the blowers with their respective compartments, the engine 122 is started to drive the blowers and the vehicle V is advanced along the area to be swept. In the present example, the blower capacity is such that the vehicle can do an efficient job of sweeping when proceeding at about 2–10 miles per hour along the surface. The circulation of air through the pickup hood P entrains the debris in the transverse duct 11 (FIGS. 5 and 6) and delivers it to the hopper H via the air return line 22. Also, dust raised by the curb brush C is drawn into the hopper by the line 24 and the air return line 22. Some makeup air flows under the flaps of the pickup hood P and into the shroud 24*a* for the curb brush and the volume of makeup air corresponds to the volume of air withdrawn from the hopper (via the filters F) by the auxiliary blower AB. This system, wherein about 3,000 c.f.m. are delivered to the pickup hood P and about 4,000 c.f.m. is exhausted from the hood by the air return line 22 does, in the manner previously described in some detail, substantially reduce puffing of dust out from under the hood flaps. The auxiliary blower AB, which draws air through the filter elements F, exhausts only filtered air to the atmosphere, so that the entire operation of the sweeper as a unit raises substantially no dust in the area surrounding the sweeper.

Although the best mode contemplated for carrying out the present invention has been herein shown and described, it will be apparent that modifications and variations may be made without departing from what is regarded to be the subject matter of the invention as defined in the appended claims.

I claim:

1. In a mobile street sweeper or the like of the type comprising a vehicle carrying a hopper, a filter associated with said hopper for separating out fine debris, sweeper means comprising a debris pickup hood having surface engaging flaps, blower means for withdrawing air from the hopper and delivering air to the hood, and an air return line for directing air from the hood back to the hopper, the improvement wherein said blower means comprises a main blower and a separate, auxiliary blower; a main blower inlet line connected to said hopper, a main blower delivery line connected to said hood; said fine debris filter having an inlet for receiving dusty air from said hopper and an outlet for filtered air connected to the inlet of said auxiliary blower, said auxiliary blower discharging filtered air to the atmosphere; the majority of the air flowing through said air return line from said hood coming from said main blower, said auxiliary blower inducing the remainder of the air flowing in said air return line which remainder corresponds to a flow of atmospheric air entering said sweeper means at the swept surface.

2. The sweeper of claim 1, wherein said sweeper means also comprises a shrouded curb broom, and a suction line for establishing communication between said curb broom shroud and said hopper.

3. The sweeper of claim 1, wherein the air flow from said main blower represents about ¾ of the total system air flow, and the air flow discharged to the atmosphere by said auxiliary blower represents about ¼ of the total system air flow.

4. In a mobile street sweeper or the like of the type comprising a vehicle carrying a hopper, a filter for fine debris associated with said hopper, sweeper means comprising a debris pickup hood having surface engaging flaps, and blower means for circulating air through said hood and returning it to the hopper; the improvement wherein said hood is a transversely disposed, elongate duct-like housing; said blower means comprising a main blower and a separate, auxiliary blower, said main blower having its inlet connected to said hopper and its outlet connected to one end of said hood; an air return line connecting the other end of said hood to the hopper; said filter having an inlet in communication with said hopper and an outlet for filtered air connected to the inlet of said auxiliary blower, said auxiliary blower discharging filtered air to the atmosphere; the quantity of air flowing out of said hood through said air return line normally exceeding the quantity of air coming from said main blower, the excess air flow in said air return line being induced by said auxiliary blower, said excess flow corresponding to a flow of atmospheric air entering said sweeper means at the swept surface.

5. The sweeper of claim 4, wherein said sweeper means also comprises a shrouded curb broom, and a suction line for establishing communication between said curb broom shroud and said hopper.

6. The sweeper of claim 4, wherein the air flow from said main blower represents about ¾ of the total system air flow, and the air flow discharged to the atmosphere by said auxiliary blower represents about ¼ of the total system air flow.

7. The sweeper of claim 4, wherein said filter comprises a plurality of porous tubular filter elements, said filter inlet establishing communication between said hopper and the outer surfaces of said filter elements, said filter outlet receiving filtered air from the interiors of said filter elements for delivery to the inlet of said auxiliary blower, and means for periodically removing dust from the outer surfaces of said filter elements.

8. The sweeper of claim 7, wherein said filter has a dust collecting chamber and a filtered air chamber with the filter elements separating said chambers; said hopper having a front partition, and an opening in said partition communicating with said filter dust collecting chamber to form said filter inlet, said outlet for filtered air leading from said filtered air chamber.

9. The sweeper of claim 8, wherein said hopper is pivotally mounted at the rear of said vehicle, and a separable sealed connection is formed in said outlet for filtered air for accomodating pivoting of said hopper while said auxiliary blower remains stationary on the vehicle.

10. The sweeper of claim 7, comprising a screen extending across said hopper below said partition opening for preventing leaves or the like from entering said filter inlet.

11. In a mobile street sweeper or the like of the type comprising a vehicle carrying a hopper, a filter associated with said hopper for separating out fine debris, sweeper means comprising a debris pickup hood having surface engaging flaps, an air flow system comprising blower means for withdrawing air from the hopper and delivering air to the hood, and an air return line for directing air from the hood back to the hopper; the improvement wherein said blower means comprises a main blower for withdrawing about ¾ of the total system air flow from the hopper and delivering it to the hood, and a separate, auxiliary blower for withdrawing about ¼ of the total system air flow from the hopper via said filter, said auxiliary blower discharging filtered air to the atmosphere, said sweeping means admitting about ¼ of the total system air flow from the atmosphere adjacent the swept surface.

12. The sweeper of claim 11, wherein the total system air flow is about 4,000 c.f.m.

13. A mobile street sweeper or the like comprising a vehicle having a chassis, a hopper, means for pivotally mounting the rear of said hopper on said chassis, said hopper having an inlet means forming a front wall, means providing an air exhaust chamber for the hopper projecting forwardly from said front wall, said chamber having a lower wall formed with an exhaust opening; a filter housing mounted on said front hopper wall and having an upper partition, tubular filter elements depending from said partition, means forming an opening in said front hopper wall for establishing communication between said hopper and the outer surfaces of said filter elements; means supported by said hopper for forming a filtered air chamber in communication with the interior of said filter elements, said filtered air chamber having a lower wall formed with a filtered air exhaust opening; a main blower and a smaller auxiliary blower mounted on said chassis; sweeper means comprising a debris pickup hood mounted on said chassis, said hood having an air inlet and an air outlet; means forming a separable sealed connection between the exhaust opening of said hopper air exhaust chamber and the inlet to said main blower, means connecting the outlet of said main blower to the air inlet of said hood, means forming a separable sealed connection between the outlet of the hood and the hopper inlet and means forming a separable sealed connection between the exhaust opening of said filtered air chamber and the air inlet of said auxiliary blower, said auxiliary blower exhausting filtered air to the atmosphere.

14. The sweeper of claim 13, wherein the lower portion of said filter housing is formed as a sump to receive dust that drops off said filter elements, a dust discharge opening in said front hopper wall at said sump, a dust retaining door for closing said dust discharge opening when the hopper is lowered to the sweeping position, and means for opening said dust retaining door when the hopper is pivotally raised for emptying the hopper.

15. The sweeper of claim 14, wherein said hopper has a rear wall formed with a hopper discharge opening, a debris retaining door for said hopper discharge opening, and means for opening said dust retaining door when said debris retaining door is opened.

16. The sweeper of claim 15, wherein said door opening means comprises means for mechanically interconnecting said doors.

* * * * *